United States Patent [19]

Gram

[11] 4,126,250

[45] Nov. 21, 1978

[54] APPARATUS FOR DISPENSING GRANULAR MATERIAL

[75] Inventor: Hans Gram, Vojens, Denmark

[73] Assignee: Brodrene Gram A/S, Vojens, Denmark

[21] Appl. No.: 766,591

[22] Filed: Feb. 8, 1977

[30] Foreign Application Priority Data

Feb. 26, 1976 [DK] Denmark ..... 829/76

[51] Int. Cl.[2] ..... G01F 11/44

[52] U.S. Cl. ..... 222/242; 366/195

[58] Field of Search ..... 222/242; 259/43, 44, 259/8

[56] References Cited

U.S. PATENT DOCUMENTS

| | | | |
|---|---|---|---|
| 1,306,313 | 6/1919 | Poulos | 259/44 X |
| 3,193,155 | 7/1965 | Hazen | 259/43 X |
| 3,709,664 | 1/1973 | Krekeler | 259/43 X |

*Primary Examiner*—Joseph F. Peters, Jr.
*Assistant Examiner*—Norman L. Stack, Jr.
*Attorney, Agent, or Firm*—Watson, Cole, Grindle & Watson

[57] ABSTRACT

An apparatus for dispensing granular material having a tendency to form lumps, comprising a container at the bottom of which an outlet opening is provided, one or more wings being provided at the bottom and being movable in such a way that the lower surface of the wings may sweep over the bottom at least at the area of the outlet opening, and a guide baffle being arranged in the container over the path of movement of the wing or the wings, the guide baffle being constructed so as to form together with the bottom of the container a space which converges in the direction towards the opening.

2 Claims, 3 Drawing Figures

APPARATUS FOR DISPENSING GRANULAR MATERIAL

BACKGROUND OF THE INVENTION

The present invention relates to an apparatus for dispensing granular material having a tendency to form lumps, comprising a container at the bottom of which an outlet opening is provided, and wherein one or more wings are provided at the bottom and are movable in such a way that the lower surfaces of the wings may sweep over the bottom at least at the area of the outlet opening, and wherein a guide baffle is arranged in the container over the path of movement of the wing or wings.

An apparatus of this kind is known from Danish patent specification No. 40.719. The guide baffle of this known apparatus is positioned above the opening in the bottom and parallel with the bottom of the container along the full extent of the guide baffle.

SUMMARY OF THE INVENTION

According to the present invention the guide baffle is arranged in such a way that the guide baffle together with the bottom of the container forms a space which converges in the direction towards the opening. By means of this construction it is achieved that an exactly defined flow will be dispensed without any overdue compression of the material and, accordingly, without any risk that the material to be dispensed forms lumps. This advantage is achieved due to the fact that the material during the movement into and through the converging space has the possibility to escape backwards, viz. opposite to the direction of movement of the wing or the wings over the upper surface of the wing or the wings.

According to a further feature of the present invention the guide baffle may be provided with an extension extending parallel with the bottom of the container and at a distance from the bottom which is only a little longer than the height of the wing or the wings. This embodiment has the advantage that granular material will be wiped away from the upper surface of the wing or the wings. Otherwise, such material may have a tendency to collect at the upper surface of the wing or the wings and such collection would reduce the possibility for the material to escape over the upper surface of the wing or the wings as explained above.

According to a further embodiment of the invention the transition between the converging part of the baffle and the extension of the baffle may be positioned opposite the opening. By means of such embodiment it is achieved that the material, as a wing passes under the extension, has the possibility to escape downwardly, viz. through the outlet and, accordingly, overdue compression of the material which by means of the wing or the wings may be moved past the outlet and into the interspace between the extension of the baffle and the bottom of the container is avoided.

In order to control the last mentioned possibility for the material to escape in accordance with the condition of the material, the guide baffle may according to a still further embodiment of the invention be adjustable in direction along the bottom.

According to a still further embodiment of the invention the wing or the wings may be secured to a rotatable shaft positioned centrally in the container and above the wing or the wings outwardly extending arms or the like stirring means may be secured to the shaft. By means of this embodiment feeding of the material to the area of the bottom which is not shielded by means of the baffle is secured because the arms or stirring means will prevent the material from forming bridges in the container and, accordingly, it is secured that the wing or the wings will be fed with material.

BRIEF DESCRIPTION OF THE DRAWINGS

Further feature of the invention will be apparent from the following description.

DESCRIPTION OF THE PREFERRED EMBODIMENT

Figure 1:
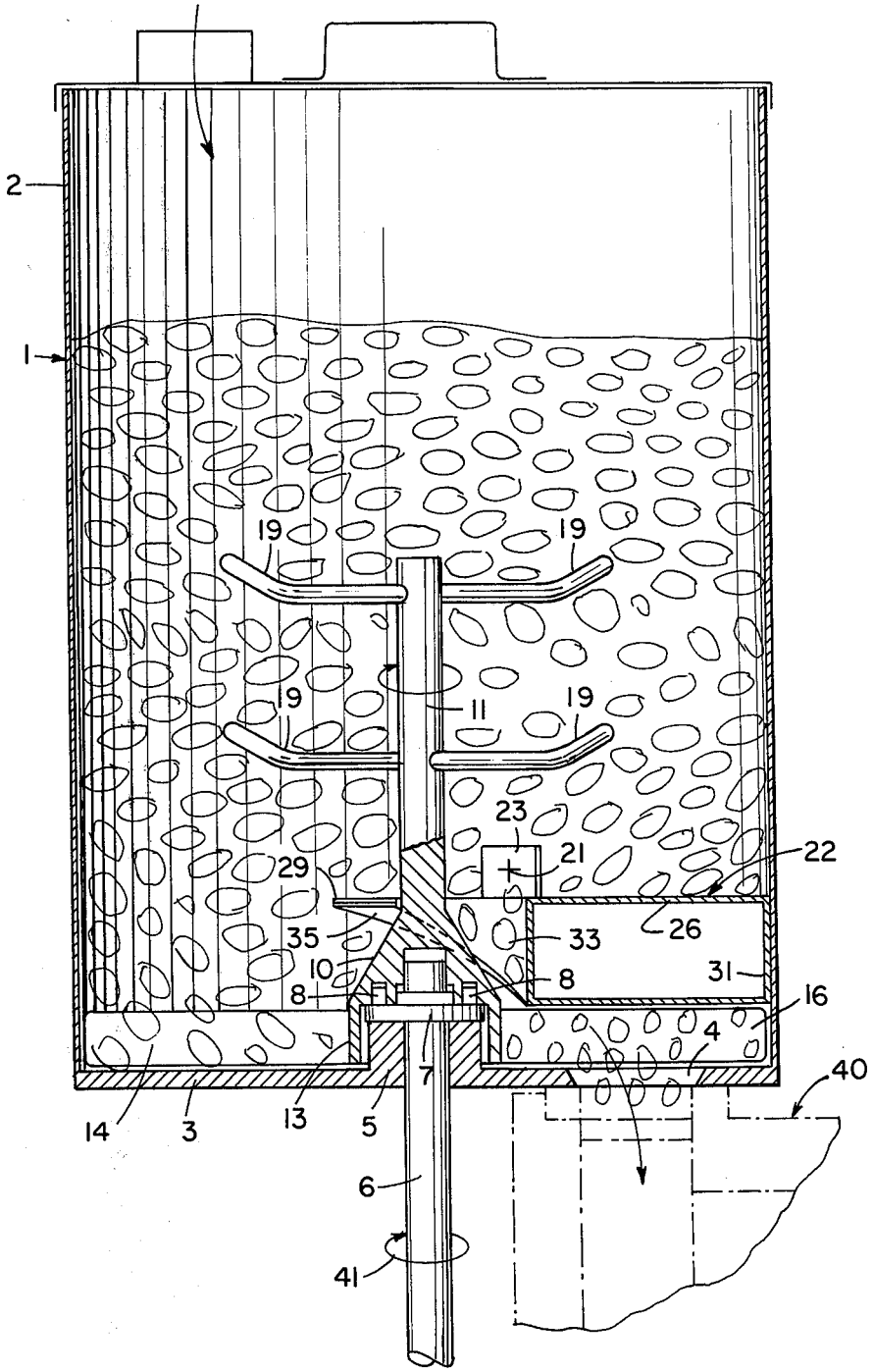
FIG. 1 shows a vertical section of a preferred embodiment of the apparatus according to the invention along section line I—I on FIG. 2.

On the drawing, 1 is a container having a cylindrical wall 2 and a flat bottom 3. In the bottom an outlet opening 4 is cut out and, moreover, the bottom supports a hub 5 at its centre for a shaft 6 which may be rotated as indicated by arrow 41 by driving means not shown on the drawing.

Near the top end the shaft 6 has a collar 7 which rests against the upper surface of the hub 5. Two pushing dogs 8 are secured to the collar 7 and each of the pushing dogs engages a blind hole in a conical part 10 at the lower end of a rod 11. From the outer surface of the conical part 10 a cylindrical skirt 13 extends downwardly along the outer surface of the hub 5 and almost to the bottom 3. Four wings or vanes 14,15,16 and 17 are secured to the skirt 13 and are of such a length that the outer ends of the wings are positioned at a short distance from the inner surface of the wall 3.

Above the conical part 10 four outwardly extending arms 19 which serve as stirring means are secured to the rod 11.

A guide baffle structure 22 is secured to the inner surface of the wall 2 by means of two screws 21 which extend through oblong holes 24 in two brackets 23 secured to the guide structure 22. Accordingly, the guide baffle structure 22 may be adjusted in the circumferential direction of the wall 2 and, accordingly, with respect to the outlet opening 4, cf. FIG. 3. The guide baffle structure has a planar upper surface 26 the outer edge of which extends along approximately 150° and the inner end of which extends the same angle about the rod 11. The ends of the upper surface 26 are defined by two generally radially extending edges 29 and 30.

The outer surface of the guide baffle structure is defined by a mantle 31 extending along the inner surface of the wall 2 and along the outer edge of the upper plate 26 to which the mantle is secured. Inwardly the guide baffle structure is defined by a vertical wall plate 33, FIG. 1, which extends coaxially with the rod 11 and the upper edge of which is connected with the inner edge of the upper plate 26.

The lower surface of the guide baffle structure consists of a plate 35, one end of which is connected with the end edge 29 of the upper plate 26. From the end edge 29 the plate 35 extends inclined downwardly and, accordingly, together with the bottom 3 of the container it forms an interspace 37 which converges towards a transition bend 38 from which the plate 35 is continuous along a planar part 39, cf. FIGS. 2 and 3. Accordingly, the planar part 39 forms an extension of the converging guide plate 35 and extends parallel with the bottom 3, whereas the inclined part 35 extends along a helicoid.

Figure 3:
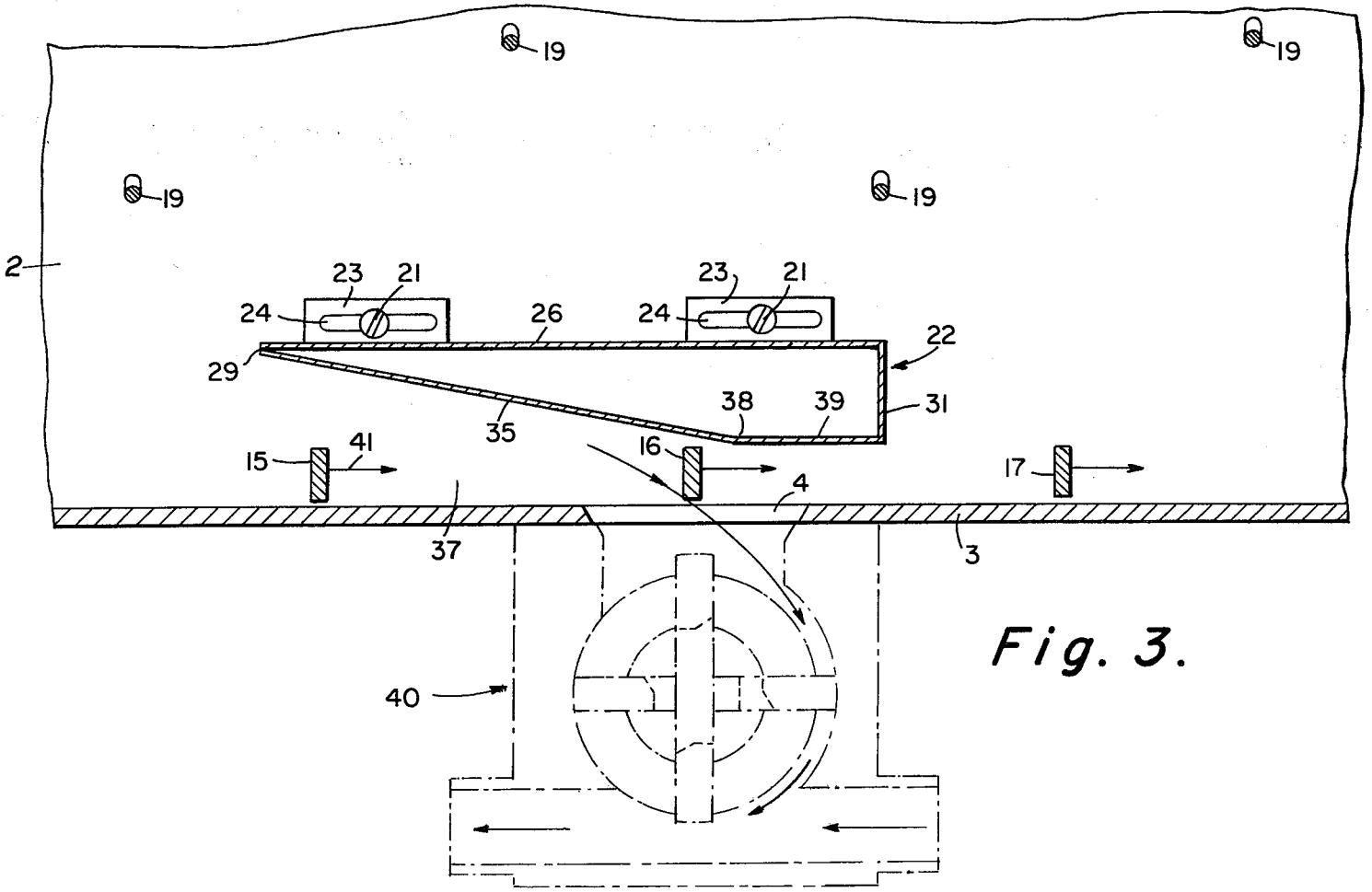
FIG. 3 shows a development of the section indicated on FIG. 2 by means of section line III—III.

As indicated by dot-and-dash lines on FIGS. 1 and 3 a dosing or mixing pump 40 is connected to the outlet opening and is fed with material via the outlet opening.

Figure 2:
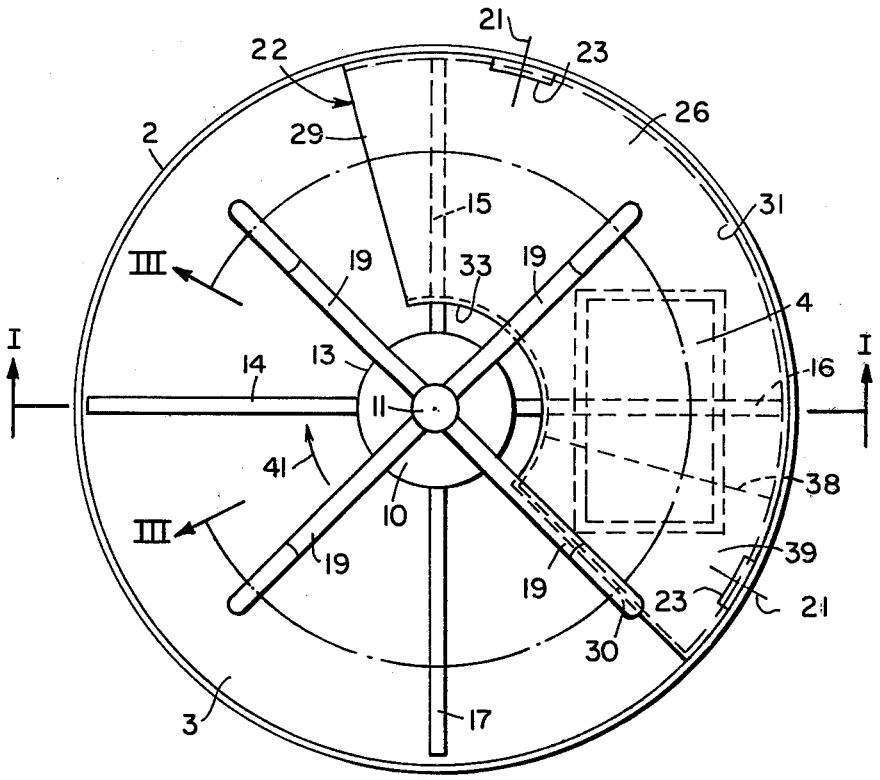
FIG. 2 shows a plan view of the apparatus of FIG. 1, wherein, however, a cover shown in FIG. 1 has been removed.

The apparatus operates in the following way:

During operation the shaft 6 is driven in direction of the arrows 41 in FIGS. 1, 2 and 3. By means of the pushing dogs 8 also the rod 11 and the arms 19 are rotated in such a way that the material in the container, e.g. sugared fruits, is maintained in a loose condition so as to insure that the material permanently has the possibility to move downwardly without any tendency to form bridges (bridging). The material resting upon the bottom 3 will be pushed by the wings 14, 15, 16 and 17 into the converging interspace 37 between the lower surface of the guide plate 35 and the upper surface of the bottom 3. By means of the wings the material will be pushed towards the outlet opening 4 through which the material will be delivered to the pump 40 so as to feed the pump. During the passage of each wing through the converging interspace 37 the material has a possibility to pass over the upper surface of the wing in question because of the distance between the upper surface of the wing and the guide plate 35. Accordingly, the material has a possibility to escape from the front side of the wings and, accordingly, only minor compression forces will be applied to the material. As it appears from FIG. 3 the bend 38 is positioned opposite the outlet opening 4 and, accordingly, the material positioned in front of a wing has the possibility to escape downwardly through the outlet opening 4 when the wing enters the interspace between the planar part 39 and the bottom 3. Accordingly, undue compression of the material which may be pushed past the opening 4 will also be avoided in the interspace between the extension 39 and the bottom 3 having constant cross section. Moreover, the planar part 39 will wipe-off the upper edge of the wings as they pass so as to avoid accumulation of material along the upper edges of the wings. Such accumulation could prevent the material from escaping, as explained above, during the passage of the wings through the converging interspace 37.

Due to the oblong holes or slots 24 in the brackets 23 it is possible to adjust the guide baffle structure 22 in the circumferential direction of the wall 2 in order to achieve optimum position of the bend 38 in accordance with the nature of the material to be delivered to the pump 40.

In the embodiment shown on the drawings, the bottom 3 is planar. However, it will be understood that also a conical bottom may be used. However, in such case the wings must have a corresponding slope and the same applies as regards the guide baffle 35 and the extension 39 of the baffle.

I claim:

1. An apparatus for dispensing granular material having a tendency to form lumps, comprising; an upright cylindrical container having a bottom wall in which an outlet opening for the material to be dispensed is provided, at least one vane having a front surface extending parallel to the central axis of said container, means secured to an inner end of said vane for disposing said vane above said bottom wall and for rotating said vane about said central axis in one direction so as to sweep over said bottom wall at least at the area of said outlet opening and to push the material toward said outlet opening, a guide baffle structure having a predetermined circumferential extent secured to an inner peripheral wall of said container and lying above said vane, said structure having a bottom surface facing said bottom wall and including a first portion lying parallel to said bottom wall so as to define an area of constant crosssection of a height permitting passage of said vane therethrough with a small clearance during rotation of said vane, said bottom surface further including a second portion which is connected to said first portion by a transition portion disposed above said outlet opening, said second portion sloping away from said bottom wall in a direction opposite said one direction.

2. The apparatus according to claim 1, wherein said means includes a rotatable shaft disposed along said central axis, said vane being secured to said shaft, and outwardly extending arms secured to said shaft above said vane for stirring the material upon rotation of said shaft.

* * * * *